United States Patent [19]

Munden et al.

[11] 3,972,315

[45] Aug. 3, 1976

[54] DUAL ACTION INTERNAL COMBUSTION ENGINE IGNITION SYSTEM

[75] Inventors: Curtis D. Munden; Robert E. Campbell, both of Anderson, Ind.

[73] Assignee: General Motors Corporation, Detroit, Mich.

[22] Filed: Oct. 21, 1974

[21] Appl. No.: 516,220

[52] U.S. Cl. ..... 123/148 E; 123/148 CB; 315/209 CD; 315/171

[51] Int. Cl.² ..... F02P 1/00

[58] Field of Search ..... 123/148 E, 148 OC; 315/171, 209 CD

[56] References Cited

UNITED STATES PATENTS

| | | | |
|---|---|---|---|
| 3,196,313 | 7/1965 | Quinn | 123/148 E |
| 3,280,809 | 10/1966 | Issler | 123/148 OC |
| 3,376,470 | 4/1968 | Stone et al. | 315/171 |
| 3,520,288 | 7/1970 | Dusenberry et al. | 123/148 E |
| 3,554,178 | 1/1971 | Boyer et al. | 123/148 E |

*Primary Examiner*—Charles J. Myhre
*Assistant Examiner*—Ronald B. Cox
*Attorney, Agent, or Firm*—Richard G. Stahr

[57] ABSTRACT

The energizing circuit of one of the primary windings of an ignition coil having at least two primary windings and a secondary winding is interrupted in timed relationship with the engine whereby a high ignition arc-creating potential is induced in the secondary winding upon each interruption of the primary winding energizing circuit. Upon each interruption of the primary winding energizing circuit, a monostable multivibrator circuit is triggered to the alternate state in which a potential signal is present upon the output circuit thereof and an electrical switching device is triggered conductive to complete a discharge circuit for an ignition capacitor through the other ignition coil primary winding. A charge potential generating circuit under the control of the potential output signal of the monostable multivibrator circuit operates to produce a direct current charge potential in response to the termination of the potential signal and to impress the direct current charge potential across the ignition capacitor.

4 Claims, 1 Drawing Figure

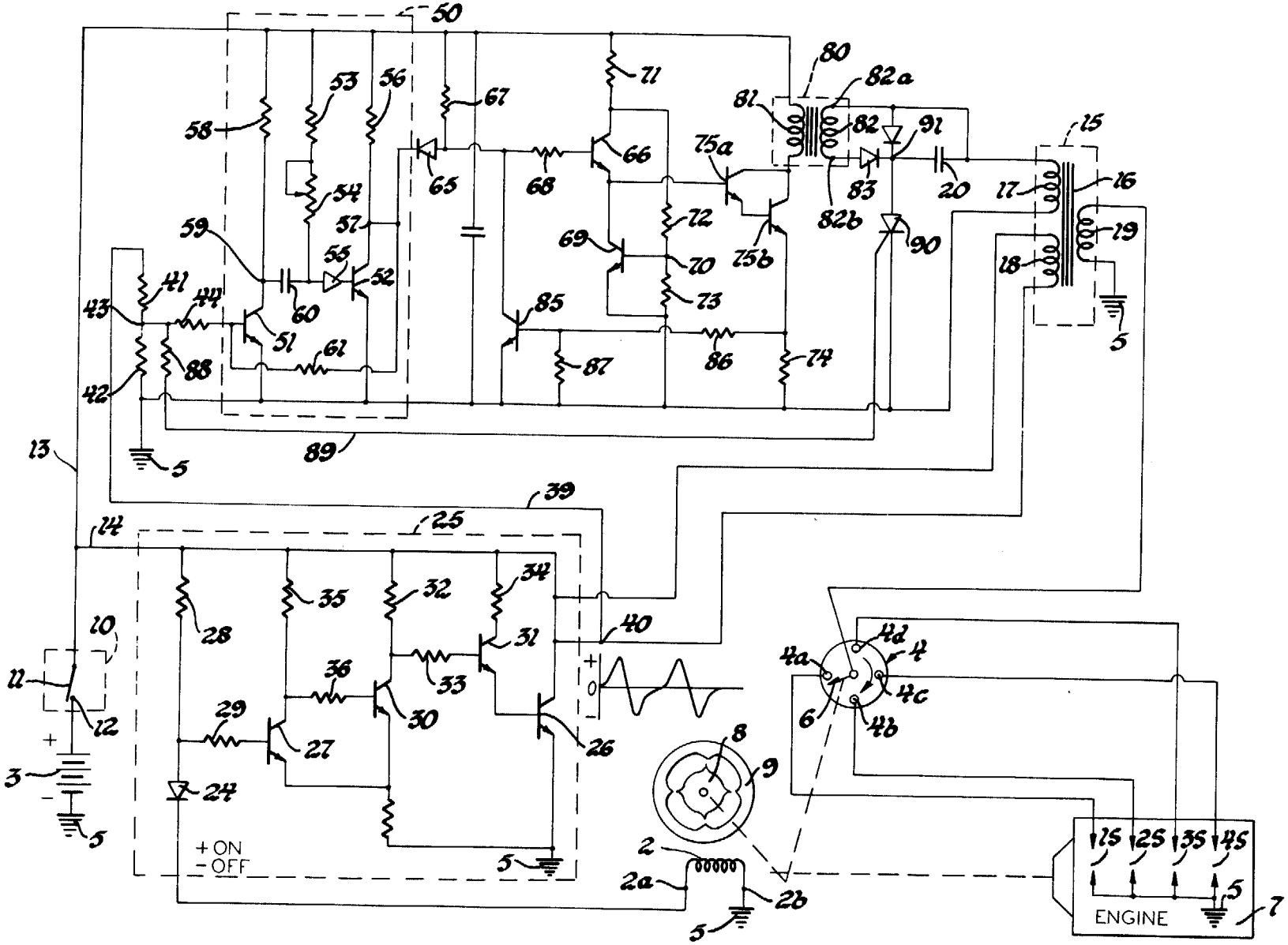
ENGINE
+ ON
- OFF

DUAL ACTION INTERNAL COMBUSTION ENGINE IGNITION SYSTEM

This invention is directed to an internal combustion engine ignition system and, more specifically, to a dual action internal combustion engine ignition system which produces a high ignition arc-creating potential in the secondary winding of the ignition coil in response to the simultaneous interruption of the energizing circuit of one or more of the ignition coil primary windings and the discharge of a capacitor through one or more other ignition coil primary windings.

In the inductive discharge type ignition systems for internal combustion engines, the primary winding of an ignition coil is connected to a source of potential through a current interrupting device which is operated in synchronism with the engine to complete and then, each time a spark plug is to be fired, to abruptly interrupt the ignition coil primary winding energizing current. The resulting induced high ignition arc-creating potential in the secondary winding is applied, usually through an ignition distributor, to the spark plugs of the engine in sequence so as to create successive fuel igniting ignition arcs across the arc gaps of the respective spark plugs. Because of certain ignition coil design limitations well known in the art, the prior art inductive type internal combustion engine ignition systems may not create a high ignition arc-creating potential in the secondary winding of a sufficiently short rise time to fire fouled spark plugs or to ignite non-homogeneous or lean fuel-air mixtures, a condition which results in engine misfire. The provision of a dual action internal combustion engine ignition system which provides a high ignition arc-creating potential of a sufficiently fast rise time to insure that fouled spark plugs are fired and to insure that non-homogeneous or lean fuel-air mixtures be ignited and which provides an ignition arc of sufficient duration to insure effective fuel-air mixture combustion is desirable.

It is, therefore, an object of this invention to provide an improved internal combustion engine ignition system.

It is an additional object of this invention to provide an improved internal combustion engine ignition system of the dual action type which provides a high ignition arc-creating potential in response to the simultaneous action of an inductive discharge ignition system and a capacitor discharge ignition system.

In accordance with this invention, a coordinated dual action internal combustion engine ignition system is provided wherein an inductive discharge ignition system and a capacitor discharge ignition system are inductively coupled to the secondary winding of an ignition coil through respective primary windings and both are simultaneously activated at the time a high ignition arc-creating potential is required to induce the high ignition arc-creating potential in the secondary winding.

For a better understanding of the present invention, together with additional objects, advantages and features thereof, reference is made to the following description and accompanying single FIGURE drawing which sets forth the dual action internal combustion engine ignition system of this invention in schematic form.

As point of reference or ground potential is the same point electrically throughout the system, it has been represented in the drawing by the accepted schematic symbol and referenced by the numeral 5.

In the drawing, the dual action internal combustion engine ignition system of this invention is set forth in schematic form in combination with direct current potential which may be a conventional automotive type storage battery 3, and an ignition distributor 4 having a movable electrical contact 6, rotated in timed relationship with an associated internal combustion engine 7, through which ignition spark energy is directed to the spark plugs of the engine individually in sequence, in a manner well known in the automotive art.

The internal combustion engine with which the dual action internal combustion engine ignition system of this invention may be used is set forth in block form, is referenced by the numeral 7 and is illustrated as having four spark plugs 1S, 2S, 3S and 4S, each having an arc gap, as is well known in the automotive art. It is to be specifically understood, however, that the ignition system of this invention may be used with internal combustion engines having more or less cylinders or with rotary type engines.

To supply operating potential to the system, movable contact 11 of an electrical switch 10 may be closed to stationary contact 12 to supply battery potential across leads 13 and 14 and point of reference or ground potential 5. Movable contact 11 and stationary contact 12 may be a pair of normally open electrical contacts included in a conventional automotive ignition switch of a type well known in the automotive art. For purposes of this specification, it will be assumed that movable contact 11 is closed to electrical contact with stationary contact 12, as is shown in FIG. 1.

The ignition coil 15 has a magnetic core 16, a primary winding 17, another primary winding 18 and a secondary winding 19. As is well known in the automotive art, a flow of energizing current through either or both of primary windings 17 and 18 produces a magnetic flux in core 16 which links secondary winding 19 and a rapid rate of change of this linking magnetic flux induces a high ignition potential of sufficient magnitude to strike an ignition arc in secondary winding 19. The rapid rate of change of magnetic flux linking secondary winding 19 may be the result of a collapsing magnetic field upon the abrupt interruption of the flow of energizing current through one or both of the primary windings, or it may be the result of a rapidly increasing magnetic field upon the rapid increase of energizing current flow through either or both of primary windings. An ignition spark potential of sufficient magnitude to initiate an ignition arc or spark across the arc gap of each of the spark plugs 1S, 2S, 3S and 4S is induced in secondary winding 19 by a collapsing magnetic field upon the interruption of the flow of energizing current through primary winding 18, in a manner well known in the automotive art, and a rapid rise time ignition spark potential also of sufficient magnitude to initiate an ignition arc or spark across the spark gap of each of the spark plugs 1S, 2S, 3S and 4S is induced in secondary winding 19 by the rapidly increasing magnetic field upon the rapid increase of energizing current flow through primary winding 17 produced by the discharge of an ignition capacitor 20 therethrough. Primary windings 17 and 18 are so polarized that the rapid rate of change of magnetic flux linking secondary winding 19 resulting from the abrupt interruption of the primary winding 18 energizing circuit and from the discharge of ignition capacitor 20 through primary winding 17 induces a high ignition arc-creating ignition potential of the same polarity relationship in secondary winding 19.

One terminal end of the ignition coil secondary winding 19 is connected to movable contact 6 of distributor 4 and output terminals 4*a*, 4*b*, 4*c* and 4*d* of distributor 4 are connected to respective spark plugs 1S, 2S, 3S and 4S.

To interrupt and complete the ignition coil primary winding 18 energizing circuit in timed relationship with engine 7, the current carrying elements of an electrical switching device which are operable to the electrical circuit open and closed conditions, are connected in series therein. Without intention or inference of a limitation thereto, this electrical switching device may be an NPN switching transistor 26 included in an electronic ignition system 25. The current carrying elements of the switching transistor 26, the collector-emitter electrodes, are operable to the electrical circuit open and closed conditions in response to electrical signals applied to the control electrode, the base electrode, and are connected in series in the ignition coil primary winding 18 energizing circuit. The ignition coil primary winding 18 energizing circuit may be traced from the positive polarity terminal of battery 3, through the closed contacts of electrical switch 10, lead 14, primary winding 18, the collector-emitter electrodes of switching transistor 26 and point of reference or ground potential 5 to the negative polarity terminal of battery 3. The collector-emitter electrodes of switching transistor 26 are operated to the electrical circuit open condition at the time each spark plug of engine 7 is to be fired in response to each of a series of ignition signals produced in timed relationship with engine 7.

The series of ignition signals may be produced in timed relationship with engine 7 by any one of the several conventional magnetic distributors well known in the automotive art. One example of a magnetic distributor well known in the automotive art suitable for use with the dual action internal combustion engine ignition system of this invention is of the variable reluctance type disclosed and described in U.S. Pat. No. 3,254,247 Falge, which issued May 31, 1966 and is assigned to the same assignee as is the present invention. In the interest of reducing drawing complexity, the variable reluctance type ignition distributor disclosed and described in the aforementioned patent is set forth in schematic form in the drawing. A rotor member 8 is rotated in timed relationship with the engine by the engine in a manner well known in the automotive art within the bore of pole piece 9. Equally spaced about the outer periphery of rotor 8 and about the bore of pole piece 9 are a series of projections equal in number to the number of cylinders of the engine with which the distributor and ignition system are being used. Pole piece 9 may be made up of a stack of a number of laminations of magnetic material secured in stacked relationship by rivets or bolts or other fastening methods and the magnetic flux may be provided by a permanent magnet, not shown, which may be secured to the lower face surface thereof. As each projection of rotor 8 approaches a projection on pole piece 9, the reluctance of the magnetic circuit between rotor 8 and pole piece 9 decreases and as each projection on rotor 8 moves away from the projection on pole piece 9, the reluctance of the magnetic circuit between rotor 8 and pole piece 9 increases. Consequently, the magnetic field produced by the permanent magnet increases and decreases as each projection on rotor 8 approaches and passes a projection on pole piece 9, a condition which induces an alternating current in pickup coil 2, which is magnetically coupled to pole piece 9, of a wave form shown in the drawing above the rotor and pole piece assembly.

During each positive polarity excursion of the series of ignition signals induced in pickup coil 2, terminal end 2*a* thereof is of a positive polarity with respect to terminal end 2*b*, consequently, diode 24 is reverse biased. While diode 24 is reverse biased, base-emitter drive current is supplied to NPN transistor 27 through resistors 28 and 29. While base-emitter drive current is supplied to transistor 27, this device conducts through the collector-emitter electrodes thereof to divert base-emitter drive current from NPN transistor 30, consequently, transistor 30 does not conduct. While transistor 30 is not conductive, base-emitter drive current is supplied to NPN transistor 31 through resistors 32 and 33, consequently, transistor 31 conducts through the collector-emitter electrodes. While transistor 31 conducts through the collector-emitter electrodes, base-emitter drive current is supplied to NPN switching transistor 26 through resistor 34 and the collector-emitter electrodes of transistor 31. While base-emitter drive current is supplied to switching transistor 26, this device conducts through the collector-emitter electrodes to complete the ignition coil primary winding 18 energizing circuit previously described. During the next negative polarity excursion of the series of ignition signals induced in pickup coil 2, terminal end 2*a* thereof is of a negative polarity with respect to terminal end 2*b*, consequently, diode 24 is forward biased. At the moment diode 24 becomes forward biased at the beginning of each negative polarity excursion of the ignition signals, base-emitter drive current is diverted from transistor 27 to extinguish this device. With transistor 27 not conducting, base-emitter drive current is supplied to transistor 30 through resistors 35 and 36, consequently, transistor 30 conducts through the collector-emitter electrodes. Conducting transistor 30 diverts base-emitter drive current from transistor 31, consequently, transistor 31 extinguishes. When transistor 31 extinguishes, base-emitter drive current is no longer supplied to switching transistor 26, consequently, switching transistor 26 extinguishes to abruptly interrupt the ignition coil primary winding 18 energizing circuit. Upon each interruption of the primary winding 18 energizing circuit, an ignition spark potential of a sufficiently high value to initiate an ignition arc across the arc gap of the spark plug to which it is directed is induced in secondary winding 19 by the resulting collapsing magnetic field in a manner well known in the automotive art. This high ignition potential is directed to the next spark plug of engine 7 to be fired through the movable contact 6 of distributor 4. From this description, it is apparent that so long as engine 7 is operating, the series of ignition signals induced in pickup coil 2 of the magnetic distributor operate electronic ignition system 25 to complete and abruptly interrupt the ignition coil primary winding 18 energizing circuit in timed relationship with engine 7.

Upon each interruption of the ignition coil primary winding 18 energizing circuit, the potential upon junction 40 is of a positive polarity with respect to point of reference or ground potential 5 and is of a magnitude substantially equal to the potential of battery 3. This potential signal is applied through lead 39 across a voltage divider network comprised of series resistors 41 and 42. Upon each interruption of the ignition coil primary winding 18 energizing circuit, therefore, the potential upon junction 43 is of a positive polarity with respect to point of reference or ground potential 5.

The base electrodes of the input transistor 51 of a conventional monostable multivibrator circuit 50 is connected to junction 43 between series resistors 41 and 42 through base resistor 44. The monostable multivibrator circuit normally operates in a stable state and may be switched to an alternate state by an electrical signal, in which it remains for a period of time as determined by an internal R-C timing network. After timing out, the device spontaneously returns to the stable state. When in the stable state, base-emitter drive current is supplied to transistor 52 through resistor 53, potentiometer 54 and diode 55, consequently, transistor 52 is conducting through the collector-emitter electrodes. While transistor 52 is conducting, most of the potential of battery 3 is dropped across collector resistor 56, consequently, junction 57 is substantially ground potential, being above ground by an amount equal to the collector-emitter potential drop through transistor 52. Upon the interruption of the ignition coil primary winding 18 energizing circuit, the positive polarity potential appearing across junction 43 and point of reference or ground potential 5 supplies base-emitter drive current to transistor 51 through base resistor 44, consequently, transistor 51 is triggered conductive through the collector-emitter electrodes. While transistor 51 is conducting through the collector-emitter electrodes, most of the potential of battery 3 is dropped across collector resistor 58 and junction 59 is of substantially ground potential, being above ground by a potential equal to the collector-emitter drop across transistor 51. When the potential upon junction 59 goes to substantially ground, transistor 52 extinguishes and timing capacitor 60 begins to charge through resistor 53, potentiometer 54 and the collector-emitter electrodes of transistor 51. When transistor 52 extinguishes, an output potential signal appears across junction 57 and point of reference or ground potential 5 of a positive polarity upon junction 57 with respect to point of reference or ground potential 5. When timing capacitor 60 has become charged through the circuit previously described, base-emitter drive current is again supplied to transistor 52 to trigger this device conductive through the collector-emitter electrodes. With transistor 52 conductive through the collector-emitter electrodes, the potential upon junction 57 is again substantially ground and is fed back to the base electrode of transistor 51 to extinguish this device. From this description, it is apparent that monostable multivibrator circuit 50 is an electrical circuit of the type which is electrically triggerable to a condition of operation during which a potential signal is present upon the output circuit thereof for a predetermined period of time and is then terminated and that monostable multivibrator circuit 50 is so triggered in response to each interruption of the ignition coil primary winding 18 energizing circuit.

When monostable multivibrator circuit 50 is electrically triggered to the alternate state upon each interruption of the ignition coil primary winding 18 energizing circuit, the positive polarity potential upon junction 57 reverse biases diode 65. While diode 65 is reverse biased, base-emitter drive current is supplied to NPN transistor 66 through resistors 67 and 68, consequently, transistor 66 is triggered conductive through the collector-emitter electrodes thereof. The base electrode of transistor 69 is connected to junction 70 between resistors 72 and 73 of a voltage divider network comprised of collector resistor 71 and resistors 72 and 73. As the potential upon junction 70 is of a sufficient magnitude to supply base-emitter drive current through NPN transistor 69, this device conducts through the collector-emitter electrodes when transistor 66 is triggered conductive. While transistors 66 and 69 are conducting, base-emitter drive current is supplied to the Darlington switching transistor pair **75*a* and 75*b* through collector resistor 71 and the collector-emitter electrodes of conducting transistor 66 to trigger the Darlington pair of transistors conductive through the collector-emitter electrodes. When transistors 75*a* and 75*b* are conducting through the collector-emitter electrodes, an energizing circuit is established for the primary winding 81 of a transformer 80 through a circuit which may be traced from the positive polarity terminal of battery 3, through the closed contacts of switch 10, lead 13, primary winding 81 of transformer 80, the collector-emitter electrodes in parallel of the transistor Darlington pairs 75*a* and 75*b*, current sensing resistor 74 and point of reference or ground potential 5 to the negative polarity terminal of battery 3. When monostable multivibrator circuit 50 spontaneously reverts to the stable state, base-emitter drive current is drained from transistor 66 through diode 65 and the collector-emitter electrodes of transistor 52 of monostable multivibrator circuit 50, consequently, transistor 66 extinguishes. When transistor 66 extinguishes, the circuit through which base-emitter drive current is supplied to the transistor Darlington pair 75*a* and 75*b* is interrupted to extinguish these devices. When the transistor Darlington pair 75*a* and 75*b* extinguish, the energizing circuit, previously described, for primary winding 81 of transformer 80, is abruptly interrupted. Upon the abrupt interruption of the energizing circuit for primary winding 81, a high potential, of the order of 400 volts, is induced in secondary winding 82 of a positive polarity upon terminal end 82*b* thereof with respect to terminal end 82*a*. This potential charges ignition capacitor 20 through diode 83 in a manner well known in the art. From this description, it is apparent that the charge potential generating circuitry comprising transistors 66 and 69, transistor Darlington pair 75*a* and 75*b* and transformer 80 is under the control of the potential output signal of monostable multivibrator circuit 50 for producing a direct current potential in response to the termination of the potential output signal of monostable multivibrator circuit 50 and for impressing the direct current potential across ignition capacitor 20** to place a charge thereupon.

Transistor 69 is not absolutely necessary to the operation of the charge potential generating circuitry just described but aids in the turn-off of the transistor Darlington pair **75*a* and 75*b*** with conditions of high temperature.

The current limiting circuitry comprising NPN transistor 85, resistors 86 and 87 and current sensing resistor 74 are not absolutely necessary but may be employed for the purpose of limiting the transformer primary winding 81 energizing current to a preselected value. The ohmic value of current sensing resistor 74 is selected to produce a potential drop thereacross of a magnitude sufficient to break down the base-emitter junction of NPN transistor 85 with a current flow therethrough equal to the preselected maximum transformer primary winding 81 energizing current. When this potential reaches a level of sufficient magnitude to break down the base-emitter junction of transistor 85, base-emitter current is supplied to this device to trigger it conductive through the collector-emitter electrodes. With transistor 85 conducting through the collector-emitter electrodes, transistor 66 is pulled out of saturation and thereafter conducts at a level sufficient to provide the base-emitter drive current to transistor Darlington pair 75*a* and 75*b* which will result in the amount of transformer primary winding 81 energizing current flow equal to the preselected maximum.

Upon the next interruption of the ignition coil primary winding 18 energizing circuit, the potential appearing across junction 43 and point of reference or ground potential 5 triggers monostable multivibrator circuit 50 to the alternate state to activate the charge potential generating circuitry previously described to complete the energizing circuit for primary winding 81 of transformer 80 and a trigger signal is supplied through resistor 88 and lead 89 to the gate electrode of a silicon controlled rectifier 90 to trigger this device conductive through the anode-cathode electrodes in a manner well known in the electronics art. When silicon controlled rectifier 90 is triggered conductive through the anode-cathode electrodes, a discharge circuit for ignition capacitor 20 is established through secondary winding 17 of ignition coil 15 which may be traced from the plate of capacitor 20 connected to junction 91, through the anode-cathode electrodes of silicon controlled rectifier 90 and primary winding 17 to the other plate of ignition capacitor 20. It is to be specifically understood that silicon controlled rectifier 90 may be replaced by any electrically operable switching device which may be operated to the electrical circuit closed condition in response to an electrical signal. From this description it is apparent that a discharge circuit for ignition capacitor 20 including primary winding 17 of ignition coil 15 is established through silicon controlled rectifier 90 which is operated to the electrical circuit closed condition in response to each interruption of the ignition coil primary winding 18 energizing circuit.

After the first complete ignition signal cycle, upon each subsequent negative polarity excursion of the ignition signal cycles, the ignition coil primary winding 18 energizing circuit is abruptly interrupted and simultaneously, the discharge circuit for ignition capacitor 20 is established through silicon controlled rectifier 90 to provide for the discharge of ignition capacitor 20 through primary winding 17 of ignition coil 15. The rapid rate of change of magnetic flux linking secondary winding 19 as a result of the collapsing magnetic field produced by the interruption of the ignition coil primary winding 18 energizing circuit and the rapid change of magnetic flux linking secondary winding 19 as a result of the increasing magnetic field produced by the discharge current of ignition capacitor 20 through ignition coil primary winding 17 induces a high ignition arc-creating potential in secondary winding 19. As the high ignition potential induced in secondary winding 19 by the discharge of capacitor 20 through primary winding 17 is of a rapid rise time but relatively short duration and the high ignition potential induced in secondary winding 19 as a result of the interruption of the energizing circuit for primary winding 18 has a slower rise time but a substantially longer duration, the simultaneous discharge of ignition capacitor 20 and interruption of the ignition coil primary winding 18 energizing circuit results in the steep wave form produced by capacitor 20 being superimposed upon the slower rising wave form produced by the interruption of ignition coil primary winding energizing circuit 18 which results in a high ignition arc-creating potential having a rise time much faster than that produced by a purely inductive system and of a duration much longer than that produced by a purely capacitor discharge system.

The ignition coil primary windings 17 and 18 are so polarized that the rapid rate of change of magnetic flux linking secondary winding 19 resulting from the abrupt interruption of the primary winding 18 energizing circuit and from the discharge of ignition capacitor 20 through primary winding 17 induces respective potentials of the same polarity relationship in ignition coil secondary winding 19.

While a preferred embodiment of the present invention has been shown and described, it will be obvious to those skilled in the art that various modifications and substitutions may be made without departing from the spirit of the invention which is to be limited only within the scope of the appended claims.

What is claimed is:

1. A dual action internal combustion engine ignition system for use with an engine having at least one ignition arc gap in communication with each combustion chamber across which an ignition arc is struck to initiate combustion within the chamber, comprising: an ignition coil having first and second discrete primary windings and a secondary winding in which a high ignition potential of sufficient magnitude to strike an ignition arc is induced upon a rapid rate of change of linking magnetic flux; an ignition coil primary winding energizing circuit for a selected one of said ignition coil primary windings through which energizing current flows upon the completion thereof; means for completing and abruptly interrupting said ignition coil primary winding energizing circuit in timed relationship with an associated engine; an electrical circuit of the type which is electrically triggerable to a condition of operation during which a potential signal is present upon the output circuit thereof for a predetermined period of time and is then terminated, said electrical circuit being so triggered in response to each interruption of said ignition coil primary winding energizing circuit; a capacitor; charge potential generating circuitry under the control of said potential output signal of said electrical circuit for producing a direct current potential in response to the termination of said potential signal and for impressing said direct current potential across said capacitor to place a charge thereupon; and a discharge circuit for said capacitor including the other one of said ignition coil primary windings and an electrically operable electrical switching device which is operated to the electrical circuit closed condition in response to each interruption of said ignition coil primary winding energizing circuit to establish said discharge circuit for said capacitor through the said other one of said primary windings of said ignition coil.

2. A dual action internal combustion engine ignition system for use with an engine having at least one ignition arc gap in communication with each combustion chamber across which an ignition arc is struck to initiate combustion within the chamber, comprising: an ignition coil having first and second discrete primary windings and a secondary winding in which a high ignition potential of sufficient magnitude to strike an ignition arc is induced upon a rapid rate of change of linking magnetic flux; an ignition coil primary winding energizing circuit for a selected one of said ignition coil primary windings through which energizing current flows upon the completion thereof; means for completing and abruptly interrupting said ignition coil primary winding energizing circuit in timed relationship with an associated engine; a monostable multivibrator circuit having a normal stable state and being triggerable by an electrical signal to an alternate state for a predetermined period of time which is triggered to said alternate state in response to each interruption of said ignition coil primary winding energizing circuit for producing a potential control signal upon the output circuit thereof which is initiated when said monostable multivibrator circuit is triggered to said alternate state and terminated at the end of said predetermined period of time; a capacitor; charge potential generating circuitry controlled by said control signal for producing a direct current potential and for impressing said direct current potential across said capacitor to place a charge thereupon; and a discharge circuit for said capacitor including the other one of said ignition coil primary windings and another electrical switching device which is operated to the electrical circuit closed condition in response to each interruption of said ignition coil primary winding energizing circuit to establish said discharge circuit for said capacitor through the said other one of said primary windings of said ignition coil, said ignition coil primary windings being so poled that the rapid rate of change of magnetic flux linking said secondary winding resulting from the abrupt interruption of said primary winding energizing circuit and from the discharge of said capacitor through the said other one of said primary windings induces high ignition potentials of the same polarity relationship in said ignition coil secondary winding.

3. A dual action internal combustion engine ignition system for use with an engine having at least one ignition arc gap in commmunication with each combustion chamber across which an ignition arc is struck to initiate combustion within the chamber, comprising: an ignition coil having first and second discrete primary windings and a secondary winding in which a high ignition potential of sufficient magnitude to strike an ignition arc is induced upon a rapid rate of change of linking magnetic flux; an ignition coil primary winding energizing circuit for a selected one of said ignition coil primary windings through which energizing current flows upon the completion thereof; means for completing and abruptly interrupting said ignition coil primary winding energizing circuit in timed relationship with an associated engine; an electrical circuit of the type which is electrically triggerable to a condition of operation during which a potential signal is present upon the output circuit thereof for a predetermined period of time and is then terminated, said electrical circuit being so triggered in response to each interruption of said ignition coil primary winding energizing circuit; a transformer having a primary winding and a secondary winding; a capacitor connected across said transformer secondary winding; an energizing circuit for said transformer primary winding including an electrical switching device which is operated to and maintained in the electrical circuit closed condition in response to and for the duration of said potential signal present upon the output circuit of said electrical circuit for establishing and abruptly interrupting said transformer primary winding energizing circuit whereby, upon each interruption, a potential is induced in said transformer secondary winding which places a charge upon said capacitor; and a discharge circuit for said capacitor including the other one of said ignition coil primary windings and another electrical switching device which is operated to the electrical circuit closed condition in response to each interruption of said ignition coil primary winding energizing circuit to establish said discharge circuit for said capacitor through the said other one of said primary windings of said ignition coil, said ignition coil primary windings being so poled that the rapid rate of change of magnetic flux linking said secondary winding resulting from the abrupt interruption of said primary winding energizing circuit and from the discharge of said capacitor through the said other one of said primary windings induces high ignition potentials of the same polarity relationship in said ignition coil secondary winding.

4. A dual action internal combustion engine ignition system for use with an engine having at least one ignition arc gap in communication with each combustion chamber across which an ignition arc is struck to initiate combustion within the chamber, comprising: an ignition coil having first and second discrete primary windings and a secondary winding in which a high ignition potential of sufficient magnitude to strike an ignition arc is induced upon a rapid rate of change of linking magnetic flux; an ignition coil primary winding energizing circuit for a selected one of said ignition coil primary windings through which energizing current flows upon the completion thereof; means for completing and abruptly interrupting said ignition coil primary winding energizing circuit in timed relationship with an associated engine; a monostable multivibrator circuit having a normal stable state and being triggerable by an electrical signal to an alternate state for a predetermined period of time during which a potential signal is present upon the output circuit thereof which is triggered to said alternate state in response to each interruption of said ignition coil primary winding energizing circuit; a transformer having a primary winding and a secondary winding; a capacitor connected across said transformer secondary winding; an energizing circuit for said transformer primary winding including an electrical switching device which is operated to and maintained in the electrical circuit closed condition in response to and for the duration of said potential signal present upon the output circuit of said monostable multivibrator circuit for establishing and abruptly interrupting said transformer primary winding energizing circuit whereby upon each interruption, a potential is induced in said transformer secondary winding which places a charge upon said capacitor; and a discharge circuit for said capacitor including the other one of said ignition coil primary windings and another electrical switching device which is operated to the electrical circuit closed condition in response to each interruption of said ignition coil primary winding energizing circuit to establish said discharge circuit for said capacitor through the said other one of said primary windings of said ignition coil, said ignition coil primary windings being so poled that the rapid rate of change of magnetic flux linking said secondary winding resulting from the abrupt interruption of said primary winding energizing circuit and from the discharge of said capacitor through the said other one of said primary windings induces high ignition potentials of the same polarity relationship in said ignition coil secondary winding.

* * * * *